US008090285B2

(12) United States Patent
Masuda

(10) Patent No.: US 8,090,285 B2
(45) Date of Patent: Jan. 3, 2012

(54) IMAGE FORMING APPARATUS

(75) Inventor: Takehiro Masuda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 502 days.

(21) Appl. No.: 12/388,019

(22) Filed: Feb. 18, 2009

(65) Prior Publication Data

US 2009/0214244 A1 Aug. 27, 2009

(30) Foreign Application Priority Data

Feb. 25, 2008 (JP) ..... 2008-043198

(51) Int. Cl.
*G03G 15/00* (2006.01)
*G03G 15/16* (2006.01)

(52) U.S. Cl. ..... 399/88; 399/122; 439/911

(58) Field of Classification Search ..... 399/88, 399/122, 107, 110; 439/911
See application file for complete search history.

(56) References Cited

U.S. PATENT DOCUMENTS 2,439,708 A * 4/1948 Abraham
3,768,064 A * 10/1973 Pabich ..... 439/911
5,301,494 A * 4/1994 Peot et al. ..... 439/911
5,646,721 A * 7/1997 Sugihara et al.
6,807,392 B2 * 10/2004 Cho ..... 399/110
7,143,940 B2 * 12/2006 Abundis et al.
2004/0184833 A1 * 9/2004 Ise ..... 399/122

FOREIGN PATENT DOCUMENTS

| | | |
|---|---|---|
| JP | 03-098466 | 10/1991 |
| JP | 2000-019927 | 1/2000 |
| JP | 2002-031924 | 1/2002 |
| JP | 2003-295553 | 10/2003 |
| JP | 2004-340997 | 12/2004 |

OTHER PUBLICATIONS

Notification of Reasons for Refusal for Japanese Application 2008-043198, mailed Nov. 26, 2009.
Notification of Reason for Refusal in corresponding Japanese Application 2008-043198 mailed on Aug. 31, 2010.

* cited by examiner

*Primary Examiner* — Susan Lee
(74) *Attorney, Agent, or Firm* — Banner & Witcoff, Ltd.

(57) ABSTRACT

An image forming apparatus includes a body casing, a fixing part, an inlet terminal and an interfering member. The fixing part is removably mounted inside the body casing and fixes a developer image onto a recording medium. The inlet terminal is provided inside the body casing, and a power cord for supplying power from an exterior is connected to the inlet terminal. The interfering member is provided at the fixing part, interposed between a predetermined part of the power cord and the inlet terminal in a state where the power cord is connected to the inlet terminal, and interferes with the predetermined part when the fixing part is moved in a removing direction with respect to the body casing.

9 Claims, 5 Drawing Sheets

IMAGE FORMING APPARATUS

CROSS-REFERENCE TO RELATED APPLICATIONS

This application claims priority from Japanese Patent Application No. 2008-043198 filed on Feb. 25, 2008, the entire subject matter of which is incorporated herein by reference.

TECHNICAL FIELD

Apparatuses consistent with the invention relate to an image forming apparatus.

BACKGROUND

JP-A-2004-340997 discloses a related art image forming apparatus that forms an image electrophotographically, in which a fixing part for fixing a toner image onto a sheet is configured as a fixing unit that takes a form of a unit and is made removable with respect to an apparatus body. In the related image forming apparatus, when the fixing part degrades, the fixing part can be replaced by a new unit.

SUMMARY

Illustrative aspects of the invention provide an image forming apparatus with which exchange of a fixing part is enabled only in a state where a supply of power from an exterior is cut off securely.

DETAILED DESCRIPTION

General Overview

Figure 1:
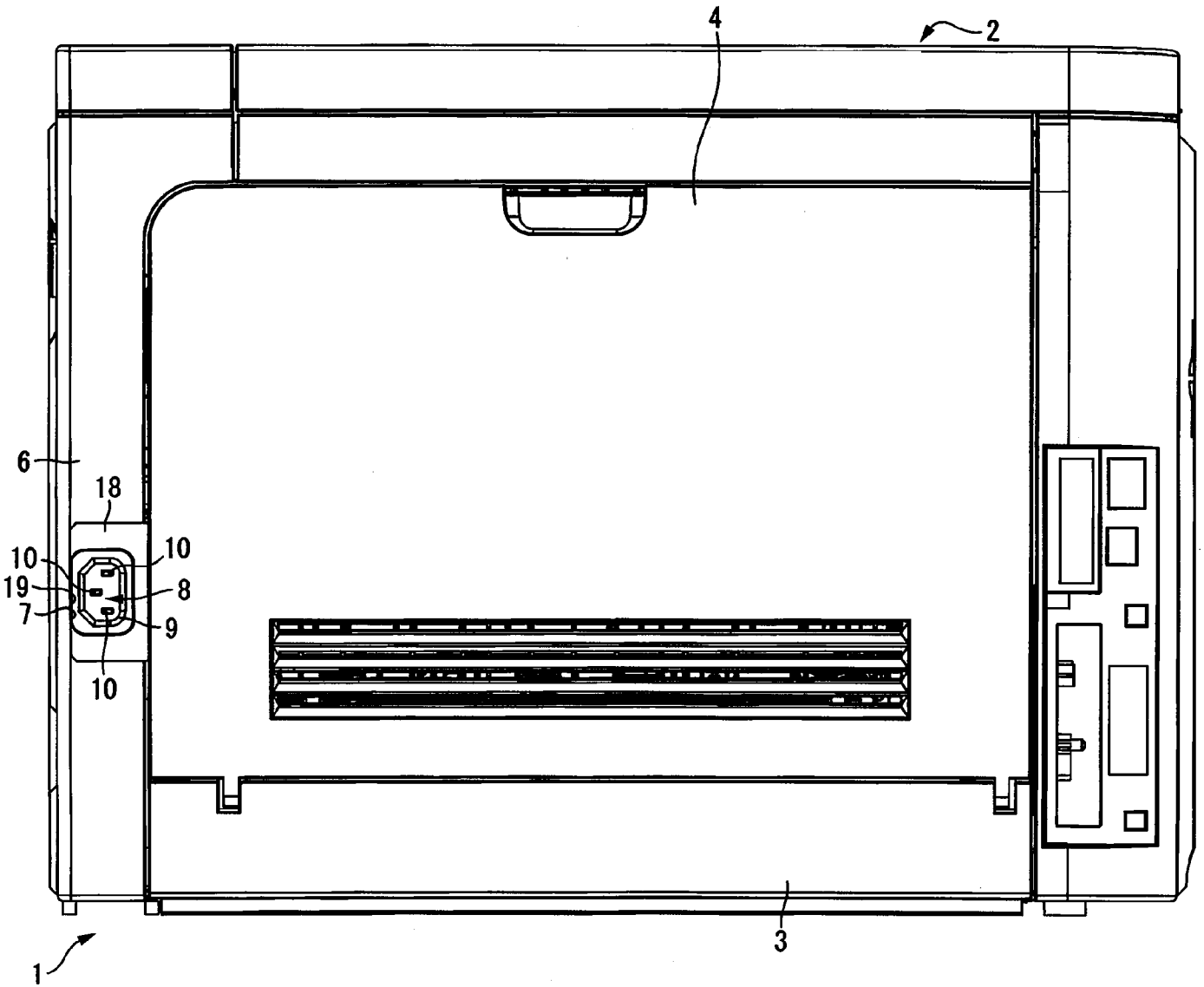
FIG. 1 is a back view of an image forming apparatus according to an exemplary embodiment of the invention.

In the related art image forming apparatus, when the fixing unit is removed from the apparatus body, an interior of the apparatus body becomes exposed and the interior becomes accessible. A contact, to which a high voltage is applied, and other components are provided in the interior of the apparatus body. Thus preferably, exchange of the fixing part is performed in a state where a power cord for supplying power to the image forming apparatus is disconnected from the apparatus body.

However, the related art image forming apparatus has some disadvantages. For example, a user who is unfamiliar with maintenance of the image forming apparatus may exchange the fixing part without disconnecting the power cord from the apparatus body. In the state where the power cord is connected to the apparatus body, there is a possibility that voltage is applied (power is supplied) to the contact, etc., provided in the interior of the apparatus body.

Therefore, illustrative aspects of the invention provide an image forming apparatus with which exchange of a fixing part is enabled only in a state where a supply of power from an exterior is cut off securely.

According to a first aspect of the invention, there is provided an image forming apparatus comprising: a body casing; a fixing part, which is removably mounted inside the body casing, and which fixes a developer image onto a recording medium; an inlet terminal, which is provided inside the body casing, and to which a power cord for supplying power from an exterior is connected; and an interfering member, which is provided at the fixing part, which is interposed between a predetermined part of the power cord and the inlet terminal in a state where the power cord is connected to the inlet terminal, and which interferes with the predetermined part when the fixing part is moved in a removing direction with respect to the body casing.

According to a second aspect of the invention, in the image forming apparatus, the fixing part comprises: a heating member that heats the recording medium; a pressing member, which is provided opposite the heating member, and which presses the recording medium against the heating member; and a fixing frame that supports the heating member and the pressing member, and the interfering member is integrally provided to the fixing frame.

According to a third aspect of the invention, in the image forming apparatus, the fixing part further comprises: a fixing cover that is movable with respect to the fixing frame in an open state and a closed state, the fixing cover opening one side of the heating member and the pressing member in the open state, and the fixing cover opposing the heating member and the pressing member from the one side in the closed state.

According to a fourth aspect of the invention, in the image forming apparatus, the body casing comprises: a body cover that is movable between an open state and a closed state, the body cover exposing the fixing part in the open state, and the body cover concealing the fixing part in the closed state, and the inlet terminal is exposed from the body cover regardless of the state of the body cover.

According to a fifth aspect of the invention, there is provided an image forming apparatus comprising: a body casing; a fixing part, which is removably mounted inside the body casing, and which fixes a developer image onto a recording medium; and an inlet portion, to which a power plug is connected, and which comprises: a first member that is integrally provided with the fixing part, at least one part of the power plug being contactable with the first member; and a second member that is provided at the body casing, the first member being removably mounted to the second member.

According to a sixth aspect of the invention, in the image forming apparatus, the first member comprises a first surface and a second surface that is opposite to the first surface, the first surface is contactable with the at least one part of the power plug, and the second surface is contactable with the second member.

According to a seventh aspect of the invention, in the image forming apparatus, the second member comprises a plug receptacle.

According to an eighth aspect of the invention, in the image forming apparatus, the first member comprises a penetrating hole having a substantially the same shape as the plug receptacle.

According to a ninth aspect of the invention, in the image forming apparatus, the second member further comprises: an inlet terminal, which is provided at an inner side of the plug receptacle, and which comprises: an inlet casing; and a terminal body provided inside the inlet casing.

According to the aspects of the invention, the fixing part for fixing the developer image onto the recording medium is removably mounted inside the body casing. The inlet terminal is provided inside the body casing. The power cord for supplying power from the exterior is connected to the inlet terminal. In the state where the power cord is connected to the inlet terminal, the interfering member is interposed between the predetermined part of the power cord and the inlet terminal, and when the fixing part is moved in the removing direction with respect to the body casing, the interfering member interferes with the predetermined part of the power cord. Movement of the fixing part in the removing direction is thereby deterred. In a case where the direction in which the power cord is disconnected from the inlet terminal is the same as the removing direction of the fixing part with respect to the body casing, when the fixing part is moved forcibly in the removing direction after the interfering member interferes with the predetermined part of the power cord, the predetermined part of the power cord is pressed in the removing direction by the interfering member and the power cord becomes disconnected from the inlet terminal. The fixing part thus cannot be removed from the interior of the body casing with the power cord remaining connected to the inlet terminal. Exchange of the fixing part is thus enabled only in a state in which the supply of power from the exterior is cut off reliably.

According to the second aspect of the invention, the fixing part includes the fixing frame. The heating member for heating the recording medium and the pressing member for pressing the recording medium against the heating member are supported on the fixing frame. The interfering member is integrally provided to the fixing frame. Thus when the fixing part is moved in the removing direction with respect to the body casing, the interfering member moves reliably in the removing direction in accordance with the movement of the fixing part. The interfering member can thus be made to interfere reliably with the predetermined part of the power cord when the fixing part is moved in the removing direction with respect to the body casing with the power cord being connected to the inlet terminal.

According to the third aspect of the invention, the fixing part includes the fixing cover. The fixing cover is provided in a manner enabling opening and closing with respect to the fixing frame. The interfering member integrally provided to the fixing frame thus does not interfere with the fixing cover and does not obstruct the opening and closing of the fixing cover. When the fixing cover is opened, one side of the heating member and the pressing member is opened. Thus when jamming (conveying fault) of the recording medium occurs between the heating member and the pressing member, a user, etc., can open the fixing cover and remove the recording medium from between the heating member and the pressing member. Because the interfering member does not interfere with the fixing cover in this process, there is no need for disconnection of the power cord from the inlet terminal. Trouble taken to treat jamming can thus be alleviated.

According to the fourth aspect of the invention, the body cover is provided in a manner enabling opening and closing at the body casing. In the state where the body cover is closed, the fixing part is concealed by the body cover. When the body cover is opened, the fixing part is exposed. The inlet terminal is exposed from the body cover regardless of the state of the body cover. The body cover can thus be opened and closed with the power cord being connected to the inlet terminal. Consequently, when jamming of the recording medium occurs in the fixing part, etc., the user, etc., can open the body cover and perform treatment of jamming, etc., without having to disconnect the power cord from the inlet terminal.

Exemplary Embodiments

Exemplary embodiments of the invention will now be described with reference to the drawings.

(Image Forming Apparatus)

Figure 2:
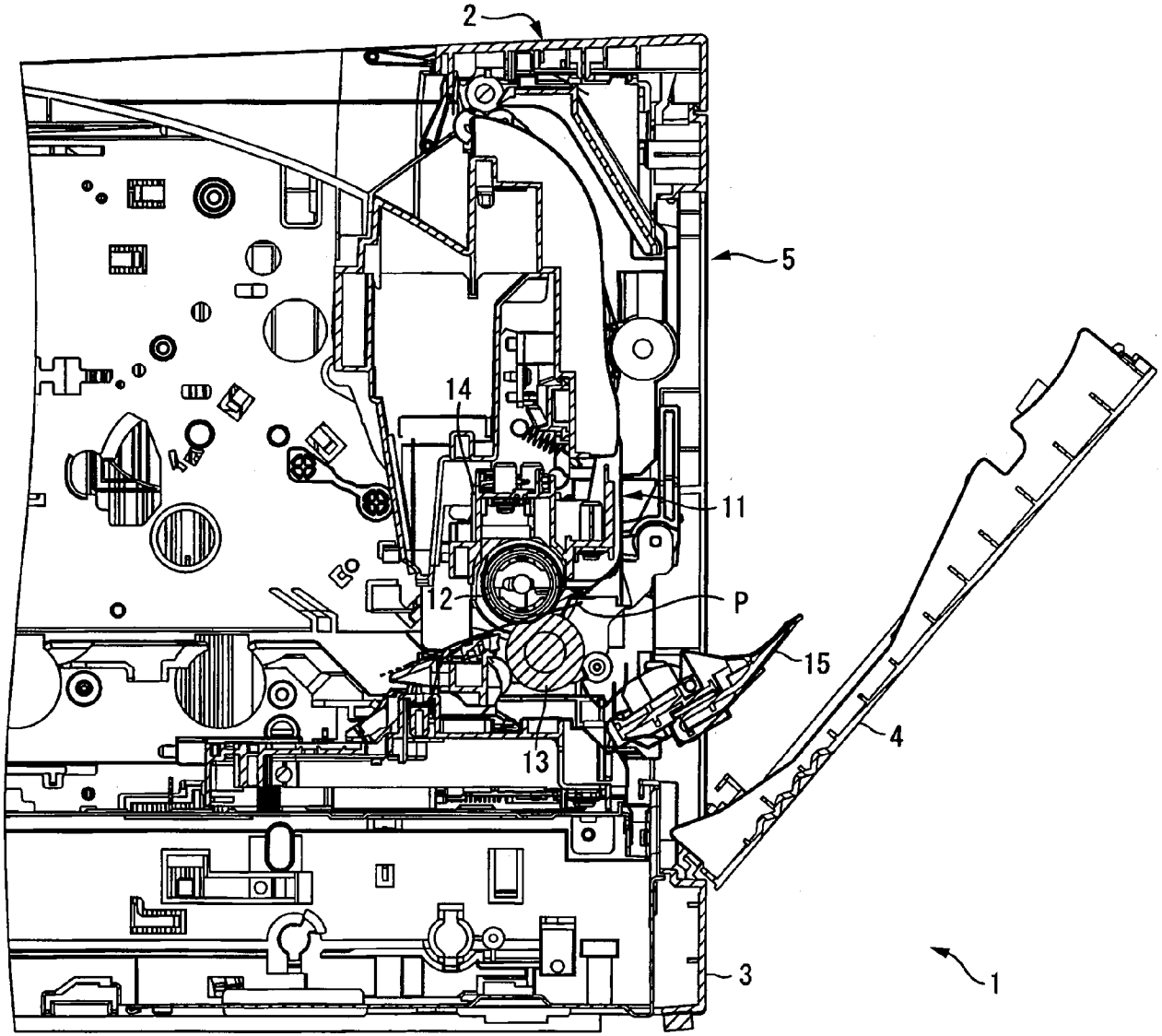
FIG. 2 is a side sectional view of a rear portion of the image forming apparatus shown in FIG. 1.

Referring to FIGS. 1 and 2, the image forming apparatus 1 includes a body casing 2 having a substantially rectangular parallelepiped shape. A photoconductor drum (not shown) is provided inside the body casing 2. A developer image is formed on a surface of the photoconductor drum by an electrophotographic method. The developer image is transferred from the surface of the photoconductor drum onto a sheet P as an example of a recording medium. Thereafter, the developer image is fixed onto the sheet P by heating and pressing.

A lower panel 3 and a rear cover 4, which is an example of a body cover, are provided at one side surface of the body casing 2.

The lower panel 3 has a substantially rectangular plate shape extending along a lower end edge of the one side surface of the body casing 2.

The rear cover 4 is provided above the lower panel 3. The rear cover 4 has a substantially rectangular plate shape and has the same width as the lower panel 3 in a direction along the lower end edge of the one side surface of the body casing 2 (hereinafter referred as the "width direction"). A lower end of the rear cover 4 is rotatably supported by a supporting shaft (not shown) extending in the width direction. The rear cover 4 can thus be opened and closed to an open state of tilting to an outer side of the body casing 2 and forming an opening 5 in the one side surface of the body casing 2 (state shown in FIG. 2) and to a closed state of extending along the one side surface of the body casing 2 and closing the opening 5 (state shown in FIG. 1).

With the image forming apparatus 1, the side at which the rear cover 4 is provided is the rear side.

At a rear surface (back surface) of the body casing 2, a side panel 6 is provided at a left side in back view of the rear cover 4. A plug receptacle 7, enabling insertion of an inlet plug 23 of a power cord 22 to be described below, is formed in the side panel 6.

An inlet terminal 8, to be connected to the inlet plug 23, is provided at an inner side of the plug receptacle 7. The inlet terminal 8 includes an inlet casing 9 and three terminal bodies 10, provided inside the inlet casing 9. The inlet casing 9 is fixed to an inner surface of the side panel 6. A recess, having an opening in communication with the plug receptacle 7 and with substantially the same shape as the plug receptacle 7 in back view, is formed in the inlet casing 9. The terminal bodies 10 protrude toward the plug receptacle 7 from a bottom surface of the recess (the surface opposing the plug receptacle 7).

Inside the body casing 2, a fixing part 11 for fixing the developer image onto the sheet P is provided at a position opposing the opening 5 as shown in FIG. 2. Thus, in the open state of the rear cover 4, the fixing part 11 is exposed to the rear, and in the closed state of the rear cover 4, the fixing part 11 is concealed by the rear cover 4.

(Fixing Part)

As shown in FIG. 2, the fixing part 11 includes a heating roller 12 as an example of a heating member for heating the sheet P, a pressing roller 13 as an example of a pressing member for pressing the sheet P against the heating roller 12, and a fixing frame 14 supporting the heating roller 12 and the pressing roller 13 in a mutually press-contacted state.

The heating roller 12 includes a metal tube, a surface of which is coated by a fluororesin, and a halogen lamp for heating, inserted inside the metal tube.

The pressing roller 13 has a configuration where a metal roller shaft is covered by a rubber material. The pressing roller 13 is provided so that its circumferential surface is press contacted from below against a circumferential surface of the metal tube of the heating roller 12.

The sheet P onto which the developer image has been transferred is conveyed toward the fixing part 11 from a front of the fixing part 11. At the fixing part 11, the sheet P passes between the heating roller 12 and the pressing roller 13. In this process the developer image on the sheet P is heated and pressed by the heating roller 12 and the pressing roller 13. Consequently, the developer image is fixed onto the sheet P.

Figure 3:
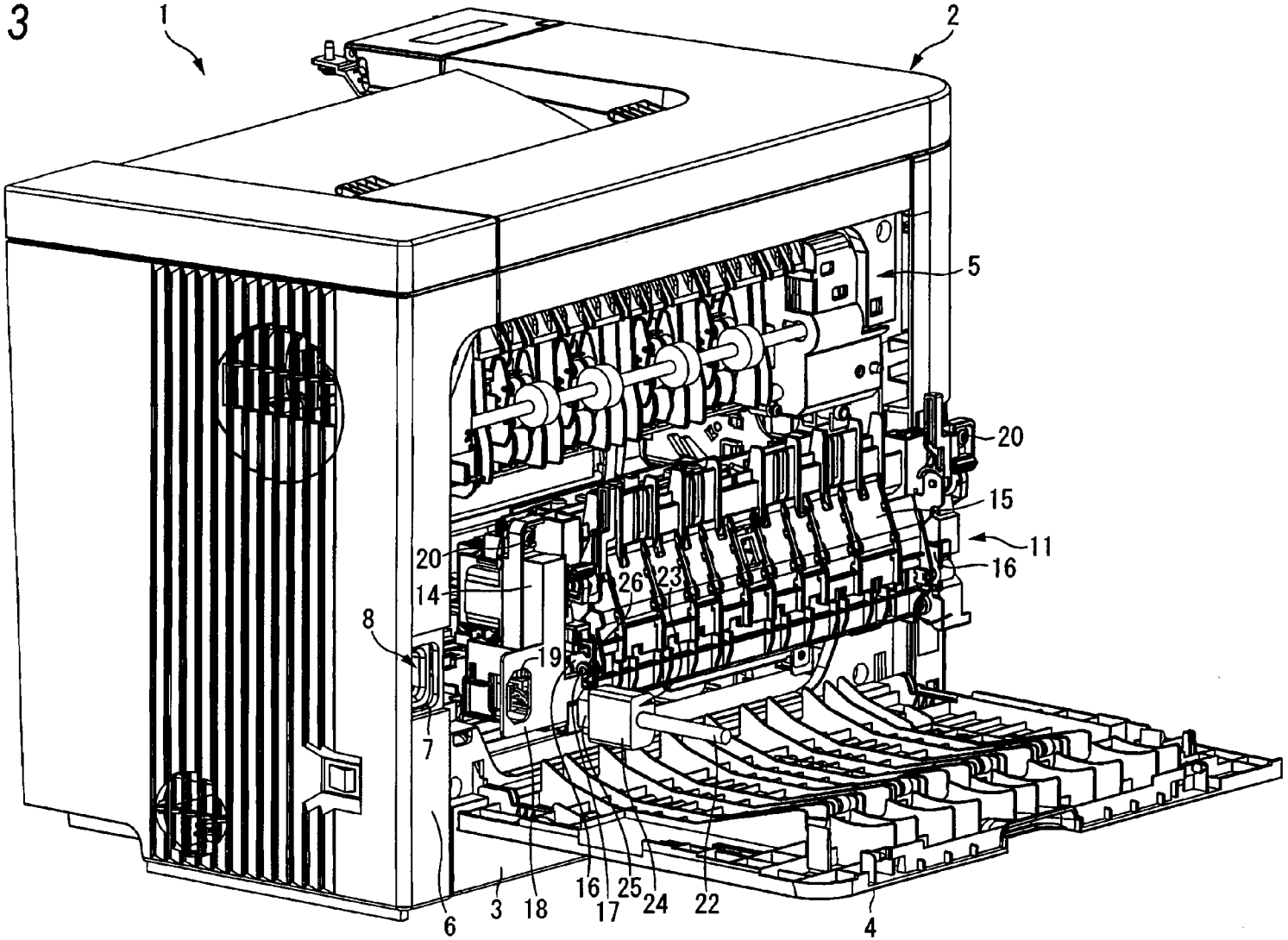
FIG. 3 is a perspective view of the rear portion of the image forming apparatus showing an intermediate state in a process of installing or removing the fixing part to or from the body casing.

As shown in FIGS. 2 and 3, the fixing part 11 includes a fixing cover 15. The fixing cover 15 is provided at the rear of the heating roller 12 and the pressing roller 13. A pair of side frames 16, mounted to the fixing frame 14 and extending in front-back and up-down directions as shown in FIG. 3, are provided at respective sides of the fixing cover 15. Supporting shafts 17, protruding to the respective sides, is provided at a lower end of the fixing cover 15. By the respective supporting shafts 17 being rotatably supported by the respective side frames 16, the fixing cover 15 is provided in a manner enabling opening and closing with respect to the fixing frame 14. In a state where the fixing cover 15 is opened (open state), the rear of the heating roller 12 and the pressing roller 13 are opened and the heating roller 12 and the pressing roller 13 are exposed to the rear as shown in FIG. 2. On the other hand, in a state where the fixing cover 15 is closed (closed state), the fixing cover 15 opposes the heating roller 12 and the pressing roller 13 from the rear and the heating roller 12 and the pressing roller 13 are concealed by the fixing cover 15 as shown in FIG. 3. In the state where the fixing cover 15 is closed, an inner surface of the fixing cover 15 serves as a guide for guiding the conveying of the sheet P onto which the developer image has been fixed.

At a left end in back view of the fixing frame 14, an interfering part 18 of substantially rectangular thin plate shape is integrally formed as an example of an interfering member. The interfering part 18 extends in the front-back and up-down directions and, as shown in FIG. 1, opposes the plug receptacle 7, formed in the side panel 6, from the rear. In the interfering part 18, a penetrating hole 19 of substantially the same shape as the plug receptacle 7 is formed in communication with the plug receptacle 7.

Figure 4:
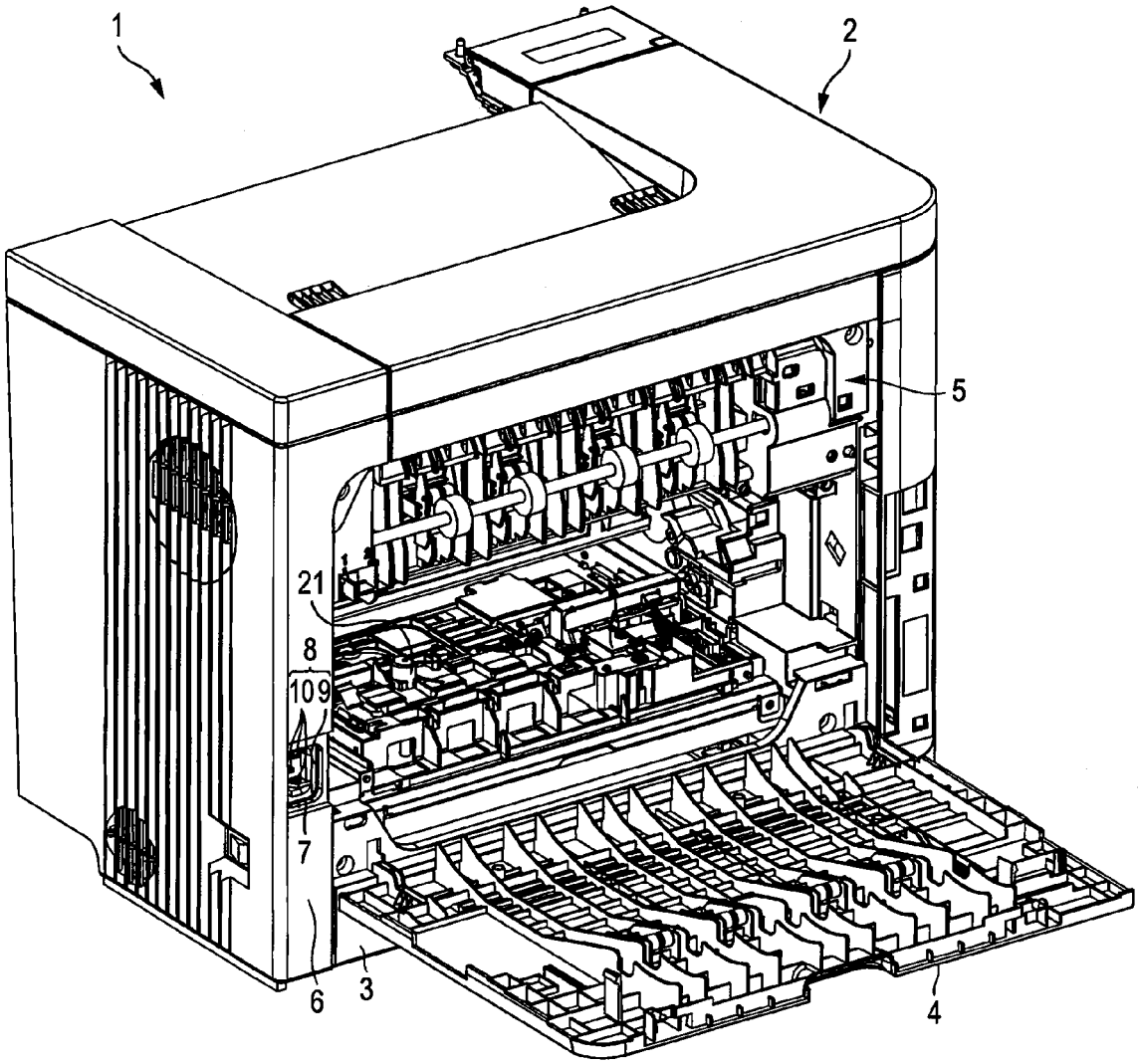
FIG. 4 is a perspective view of the rear portion of the image forming apparatus showing a state where the fixing unit has been removed from the body casing.

The fixing part 11 is configured in a removable manner inside the body casing 2. That is, as shown in FIG. 3, the fixing part 11 can be removed to the rear (removing direction) from inside the body casing 2 and be installed inside the body casing 2 from the rear of the body casing 2 via the opening 5 formed in the back surface of the body casing 2 in the open state of the rear cover 4. In the state where the fixing part 11 is installed inside the body casing 2, the fixing part 11 is fixed to the body casing 2 by screws 20, respectively inserted through an upper left corner and an upper right corner in back view of the fixing frame 14, being screwed into predetermined parts (not shown) of the body casing 2. In the state where the fixing part 11 is removed from inside the body casing 2, an inner (front) portion of a mounting position of the fixing part 11 is widely exposed as shown in FIG. 4. Contacts 21, to which a high voltage is applied, and other components are provided at the exposed part.

(Power Cord)

During use of the image forming apparatus 1, the power cord 22 for supplying power from an exterior is connected to the inlet terminal 8. A power plug is connected to an inlet member of the image forming apparatus 1. For example, as shown in FIGS. 3 and 5, the power cord 22 has an inlet plug 23 at one end and an outlet plug (not shown) at the other end.

The inlet plug 23 integrally includes a plug body 24 and a plugged-in part 25, formed at a front end side of the plug body 24 and plugged into the inlet casing 9 of the inlet terminal 8. The plugged-in part 25 has a shape corresponding to the recess of the inlet casing 9. The plug body 24 has a size larger than the plugged-in part 25 as viewed from the plug body 24 side. The inlet plug 23 thus has a stepped surface 26 as an example of a predetermined part formed by the plug body 24 and the plugged-in part 25.

Figure 5:
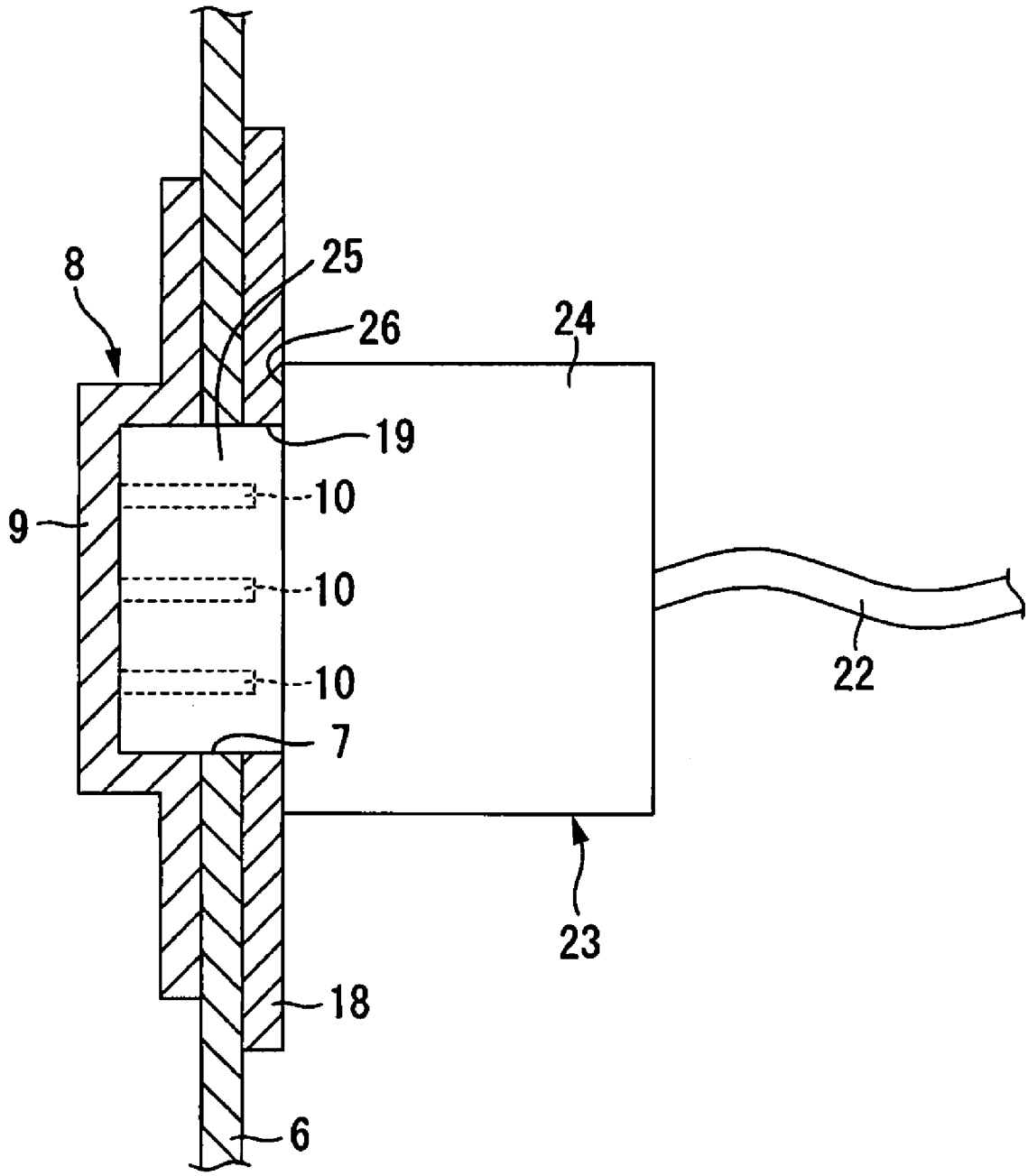
FIG. 5 is a side sectional view showing a state where the power cord is connected to the inlet terminal.

As shown in FIG. 5, in a state where the plugged-in part 25 of the inlet plug 23 is inserted in the inlet casing 9 of the inlet terminal 8, the respective terminal bodies 10 of the inlet terminal 8 are inserted in the plugged-in part 25. Connection of the inlet terminal 8 and the inlet plug 23 (power cord 22) is thereby achieved. Also in the state where the plugged-in part 25 of the inlet plug 23 is inserted in the inlet casing 9, the stepped surface 26 of the inlet plug 23 contacts the interfering part 18, provided at the back surface of the side panel 6, from the rear. The side panel 6 and the interfering part 18 are thus interposed between the inlet casing 9 of the inlet terminal 8 and the stepped surface 26 of the inlet plug 23.

Meanwhile, the outlet plug is connected to a commercial power outlet (outlet terminal). When the outlet plug is connected to the outlet in a state where the inlet plug 23 is connected to the inlet terminal 8, power is supplied to the inlet terminal 8 via the power cord 22. The power supplied to the inlet terminal 8 is supplied via the contacts 21, etc., to respective parts provided inside the body casing 2.

As described above, the fixing part 11 for fixing the developer image onto the sheet P is removably mounted inside the body casing 2. The inlet terminal 8 is provided inside the body casing 2. The power cord 22 (inlet plug 23) for supplying power from the exterior is connected to the inlet terminal 8. In the state where the power cord 22 is connected to the inlet terminal 8, the interfering part 18 is interposed between the stepped surface 26, provided on the power cord 22, and the inlet terminal 8 (inlet casing 9), and when the fixing part 11 is moved in the removing direction with respect to the body casing 2, the interfering part 18 interferes with the stepped surface 26 of the power cord 22. Movement of the fixing part 11 in the removing direction is thereby deterred. When the fixing part 11 is moved forcibly in the removing direction after the interfering part 18 interferes with the stepped surface 26, the stepped surface 26 is pressed in the removing direction by the interfering part 18 and the power cord 22 becomes disconnected from the inlet terminal 8. The fixing part 11 thus cannot be removed from the interior of the body casing 2 with the power cord 22 remaining connected to the inlet terminal 8. The fixing part 11 can thus be removed from inside the body casing 2 and a new fixing part 11 can be installed inside the body casing 2 only in a state in which the supply of power from the exterior is cut off reliably. Exchange of the fixing part 11 is thus enabled only in the state in which the supply of power from the exterior is cut off reliably.

The fixing part 11 includes the fixing frame 14. The heating roller 12 for heating the sheet P and the pressing roller 13 for pressing the sheet P against the heating roller 12 are supported on the fixing frame 14. The interfering part 18 is integrally provided to the fixing frame 14. Thus when the fixing part 11 is moved in the removing direction with respect to the body casing 2, the interfering part 18 moves reliably in the removing direction in accordance with this movement. Thus when the fixing part 11 is moved in the removing direction with respect to the body casing 2 with the power cord 22 being connected to the inlet terminal 8, the interfering part 18 can be made to interfere reliably with the predetermined part of the power cord 22.

The fixing part 11 includes the fixing cover 15. The fixing cover 15 is provided at the fixing frame 14 in a manner enabling opening and closing. The interfering part 18 integrally provided to the fixing frame 14 thus does not interfere with the fixing cover 15 and does not obstruct the opening and closing of the fixing cover 15. When the fixing cover 15 is opened, one side of the heating roller 12 and the pressing roller 13 is opened. Thus when jamming (conveying fault) of the sheet P occurs between the heating roller 12 and the pressing roller 13, a user, etc., can open the fixing cover 15 and remove the sheet P from between the heating roller 12 and the pressing roller 13. Because the interfering part 18 does not interfere with the fixing cover 15 in this process, there is no need for disconnection of the power cord 22 from the inlet terminal 8. Trouble taken to treat jamming can thus be alleviated.

Furthermore, the rear cover 4 is provided in a manner enabling opening and closing at the body casing 2. In the state where the rear cover 4 is closed, the fixing part 11 is concealed by the rear cover 4. When the rear cover 4 is opened, the fixing part 11 is exposed. The inlet terminal 8 is exposed from the rear cover 4 regardless of the state of the rear cover 4. The rear cover 4 can thus be opened and closed with the power cord 22 being connected to the inlet terminal 8. Consequently, when jamming of the sheet P, etc., occurs in the fixing part 11, the user, etc., can open the rear cover 4 and perform treatment of jamming, etc., without having to disconnect the power cord 22 from the inlet terminal 8.

Modified Exemplary Embodiments

The invention is not limited to the above-described exemplary embodiments, and the invention can be put into practice in other modes as well. For example, a sensor for detecting the open state of the rear cover 4 may be provided inside the body casing 2, and the supply of power from the inlet terminal 8 to the contacts 21, etc., provided inside the body casing 2 may be cut off by cutting off a relay, electrically connected to the inlet terminal 8, in response to detection of the open state of the rear cover 4. The supply of power to the contacts 21, etc., can thereby be cut off immediately in response to the rear cover 4 being put in the open state. Thus not only exchange of the fixing part 11 but treatment of jamming at the fixing part 11, etc., is also enabled only in the state where the supply of power to the contacts 21, etc., is cut off.

The image forming apparatus 1 may be of any type as long as it is of the electrophotographic type. That is, the invention can be widely applied to a printer, forming an image (a monochromatic image or a color image) on the sheet P based on image data input from the exterior, a copier, forming an image on the sheet P based on image data obtained by reading an original image, a facsimile apparatus, forming an image on the sheet P based on image data input via a telephone line, etc.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

a body casing;

a fixing part, which is removably mountable inside the body casing, and which is configured to fix a developer image onto a recording medium; and an inlet portion, to which a power plug is connectable, and which comprises:

a first member that is integrally provided with the fixing part, at least one part of the power plug being contactable with the first member; and a second member that is provided at the body casing, the first member being removably mountable to the second member.

2. The image forming apparatus according to claim 1, wherein the first member comprises a first surface and a second surface that is opposite to the first surface, wherein the first surface is contactable with the at least one part of the power plug, and wherein the second surface is contactable with the second member.

3. The image forming apparatus according to claim 1, wherein the second member comprises a plug receptacle.

4. The image forming apparatus according to claim 3, wherein the first member comprises a penetrating hole having a substantially the same shape as the plug receptacle.

5. The image forming apparatus according to claim 3, wherein the second member further comprises:

an inlet terminal, which is provided at an inner side of the plug receptacle, and which comprises:

an inlet casing; and a terminal body provided inside the inlet casing.

6. An image forming apparatus comprising:

a body casing;

a fixing part, which is removably mountable inside the body casing, and which is configured to fix a developer image onto a recording medium;

an inlet terminal, which is provided inside the body casing, and to which a power cord for supplying power from an exterior is connectable; and an interfering member, which is provided at the fixing part, which is configured to be interposed between a predetermined part of the power cord and the inlet terminal in a state where the power cord is connected to the inlet terminal, and which is configured to interfere with the predetermined part when the fixing part is moved in a removing direction with respect to the body casing.

7. The image forming apparatus according to claim 6, wherein the fixing part comprises:

a heating member configured to heat the recording medium;

a pressing member, which is provided opposite the heating member, and which configured to press the recording medium against the heating member; and a fixing frame that supports the heating member and the pressing member, and wherein the interfering member is integrally provided to the fixing frame.

8. The image forming apparatus according to claim 7, wherein the fixing part further comprises:

a fixing cover that is movable with respect to the fixing frame in an open state and a closed state, the fixing cover opening one side of the heating member and the pressing member in the open state, and the fixing cover opposing the heating member and the pressing member from the one side in the closed state.

9. The image forming apparatus according to claim 6, wherein the body casing comprises:

a body cover that is movable between an open state and a closed state, the body cover exposing the fixing part in the open state, and the body cover concealing the fixing part in the closed state, and wherein the inlet terminal is exposed from the body cover regardless of the state of the body cover.

* * * * *